US005544779A

United States Patent [19]

Yamamoto et al.

[11] Patent Number: 5,544,779

[45] Date of Patent: Aug. 13, 1996

[54] SAFETY DEVICE FOR PRESSURE VESSEL

[75] Inventors: Katsuya Yamamoto, Konosu; Norifumi Inada, Sagamihara, both of Japan

[73] Assignees: Sanyo Electric Co., Ltd., Osaka-fu; Coca-Cola (Japan) Co., Ltd., Tokyo-to, both of Japan

[21] Appl. No.: 267,707

[22] Filed: Jun. 29, 1994

[30] Foreign Application Priority Data

| | | | |
|---|---|---|---|
| Jun. 30, 1993 | [JP] | Japan | 5-188908 |
| Oct. 1, 1993 | [JP] | Japan | 5-269754 |
| Jun. 9, 1994 | [JP] | Japan | 6-151518 |

[51] Int. Cl.[6] ..... B65D 51/16

[52] U.S. Cl. ..... 220/89.2; 220/203.08; 220/601

[58] Field of Search ..... 220/89.1, 89.2, 220/207, 582, 583, 601, 203.08

[56] References Cited

U.S. PATENT DOCUMENTS

| | | | |
|---|---|---|---|
| 1,753,259 | 4/1930 | Badger | 220/583 |
| 2,425,448 | 8/1947 | Weida | 220/583 |
| 2,630,936 | 3/1953 | Freygang | 220/583 |
| 3,244,316 | 4/1966 | Atkinson et al. | 220/89.2 |
| 5,197,622 | 3/1993 | Anderson | 220/89.2 |

FOREIGN PATENT DOCUMENTS

| | | | |
|---|---|---|---|
| 2336889 | 4/1974 | Germany | 220/89.2 |

*Primary Examiner*—Stephen K. Cronin
*Attorney, Agent, or Firm*—Darby & Darby, P.C.

[57] ABSTRACT

A safety device for a pressure vessel comprises an easily-breakable member-having a small thickness and a fixing portion formed in the pressure vessel for fixing the easily-breakable member therein. The easily-breakable member has a top wall portion formed with a breakable portion, and a peripheral wall portion having an end. The fixing portion has a wall portion which extends toward the inside of the pressure vessel such that it defines an opening having a shape complementary to a periphery of the easily-breakable member to permit communication between the inside of the pressure vessel and the outside of the pressure vessel. The wall portion has an inner end. The easily-breakable member is fit into the opening of the fixing portion such that the end of the peripheral wall portion is directed toward the inside of the vessel, and the end of the peripheral wall portion of the easily-breakable member and the inner end of the wall portion of the fixing portion are welded to each other for sealing the opening.

22 Claims, 8 Drawing Sheets

SAFETY DEVICE FOR PRESSURE VESSEL

BACKGROUND OF THE INVENTION

1. Field of the Invention

This invention relates to a safety device provided for a pressure vessel, such as a syrup tank for use in a vending machine.

2. Prior Art

Some vending machines include a syrup tank for supplying a syrup (condensed liquid) under pressure to a cooking block thereof. The syrup tank of this kind is adapted to be pressurized by carbon dioxide gas or nitrogen gas regulated approximately to 4 kg/cm$^2$ by a gas regulator, for supplying the condensed liquid held therein to the cooking system. Although such syrup tanks do not fall within a legal category of the pressure vessel, they are provided with a safety device, taking the safety into consideration.

FIG. 1A and FIG. 1B show a conventional safety device provided for a syrup tank. This safety device is comprised of a easily-breakable portion 62 formed in a cover 61 of the tank. The cover 61 is made of stainless steel, and the easily-breakable portion 62 thereof is formed by pressing central portions of the cover into two arcuate projections, and then cutting off tops of these projections. That is, the easily-breakable portion 62 is shaped into thinner portions by cutting compared with the remaining part of the cover, whereby these portions are preferentially permitted to be broken when pressure within the syrup tank exceeds a predetermined burst pressure at which these portions are to be broken, thus functioning as the safely device. For example, a cover 61 having a thickness of 1.5 mm is formed with an easily-breakable portion 62 having a thickness below 0.1 mm, which satisfies a specification of a burst pressure level of 21 kg/cm$^2$ to 35 kg/cm$^2$.

The working pressure of such a syrup tank, however is 4 kg/cm$^2$, so that a high burst pressure of 21 kg/cm$^2$ to 35 kg/cm$^2$ of the safety device may cause excessively high pressure applied to the syrup tank or pressure piping, if there is failure in the gas regulator or other related parts and devices. This problem can be solved by setting the burst pressure of the safety device to a lowered level of 10 kg/cm$^2$ or its vicinity. However, this requires precision processing of a stainless steel plate to a thickness of an order of 0.01 mm in forming the easily-breakable portion 62 of such a safety device, which is conventionally formed by pressing and cutting to a thickness of 0.1 mm. It is expected that this precision processing by pressing and cutting requires an extremely high craftsmanship or skill in manual operations, and further it is practically impossible to effect such processing, when taking the composition of stainless steel (homogeneity of its metallographic structure) into consideration. That is, the construction of the conventional safety device suffers from a limitation in respect of processing techniques, in delimiting the burst pressure applied to the easily-breakable portion 62 to a low level of 10 kg/cm$^2$ or its vicinity.

If the cover 61 per se is formed of stainless steel having a small thickness, it is relatively easy to form recesses reduced in thickness which will be broken at a desired burst pressure. However, the reduced thickness of the cover 61 causes a problem of insufficient strength thereof.

SUMMARY OF THE INVENTION

It is the object of the invention to provide a safety device for a pressure vessel, which stably operates at a relatively low pressure level, and is capable of being easily formed in the pressure vessel.

To attain the above object, the present invention provides a safety device for a pressure vessel comprising:

an easily-breakable member having a small thickness, the easily-breakable member having a top wall portion formed with a breakable portion, and a peripheral wall portion having an end; and a fixing portion formed in the pressure vessel wall portion is directed toward the inside of the vessel, the end of the peripheral wall portion of the easily-breakable member and the inner end of the wall portion of the fixing portion are welded to each other for sealing the opening. Therefore, it is possible to easily join the easily-breakable portion having the smaller thickness and the fixing portion having the larger thickness to each other without impairing the air-tightness of the pressure vessel.

Preferably, the opening defined by the wall portion of the fixing portion has a circular transverse cross-section, and the peripheral wall portion of the easily-breakable member is tapered toward the top wall portion.

According to this preferred embodiment, by virtue of the arrangement that the opening defined by the wall portion of the fixing portion has a circular transverse cross-section, and the peripheral wall portion of the easily-breakable member is tapered toward the top wall portion, when the easily-breakable member is inserted into the opening of the fixing portion, the wall of the fixing portion and the peripheral wall portion of the easily-breakable member are tightly attached to each other without forming a gap, whereby it is possible to weld the easily-breakable member having the smaller thickness and the fixing portion having the larger thickness in an airtight manner. Further, the easily-breakable portion is urged on the wall of the fixing portion, it is easy to maintain the sealed state of the opening while withstanding a predetermined range of pressure within the pressure vessel.

Preferably, the easily-breakable member is formed of stainless steel.

According to this preferred embodiment, since the easily-breakable portion is formed of stainless steel, it is possible to prevent the easily-breakable portion from being deteriorated due to rust, and to manufacture the whole of the easily-breakable portion together with the breakable portion (very thin portions) with ease.

Further preferably, the breakable portion of the top wall portion of the easily-breakable member is comprised of portions in the form of a cross, each having a thickness corresponding to a predetermined burst pressure level.

According to this preferred embodiment, since the breakable portion is formed of portions in the form of a cross, it is possible to prevent the burst pressure of the breakable portion from become extremely high compared with a design pressure level, even if the composition of the easily-breakable member is not longitudinally or crosswise homogeneous in a horizontal plane.

Further preferably, the top wall portion of the easily-breakable member is formed such that it is curved toward the inside of the pressure vessel.

According to this preferred embodiment, since the top wall portion of the easily-breakable member is formed such that it is curved toward the inside of the pressure vessel, the strength of the top wall is increased by virtue of the structure, which makes it possible to reduce the thickness of the easily-breakable member. Further, the easily-breakable member is less liable to be directly hit by an object, which makes it possible to effectively prevent the easily-breakable member from being damaged.

Further preferably, the welding of the end of the peripheral wall portion of the easily-breakable member and the inner end of the wall portion of the fixing portion is performed by heating the inner end of the wall portion of the fixing portion along the circumference of the opening, for fusion, with the wall portion of the fixing portion being used as a base metal.

According to this preferred embodiment, it is possible to properly weld the fixing portion having the larger thickness and the easily-breakable member having the smaller thickness, without damaging the easily-breakable member in welding.

Further preferably, the safety device further comprises a protective member for shielding an outer end of the opening of the fixing portion to thereby protect the easily-breakable member.

According to this preferred embodiment, it is possible to protect the easily-breakable member from external forces when the pressure vessel is washed or conveyed, thereby preventing the easily-breakable member from being carelessly damaged.

Further preferably, the protective member and the easily-breakable member are joined to each other.

According to this preferred embodiment, since the protective member and the easily-breakable member are joined to each other, when the easily-breakable member 10 is fit into the outer end of the fixing portion, the protective member abuts on the peripheral edge of the fixing opening to thereby automatically effect positioning of the easily-breakable member. Therefore, it is possible to easily align the inner end of the peripheral wall of the easily-breakable member and the inner end of the wall portion of the fixing portion and hold them in the aligned state, when welding is performed, which facilitates the work of welding.

The above and other objects, features, and advantages of the invention will become more apparent from the following detailed description taken in conjunction with the accompanying drawings.

DETAILED DESCRIPTION

Figure 1A:
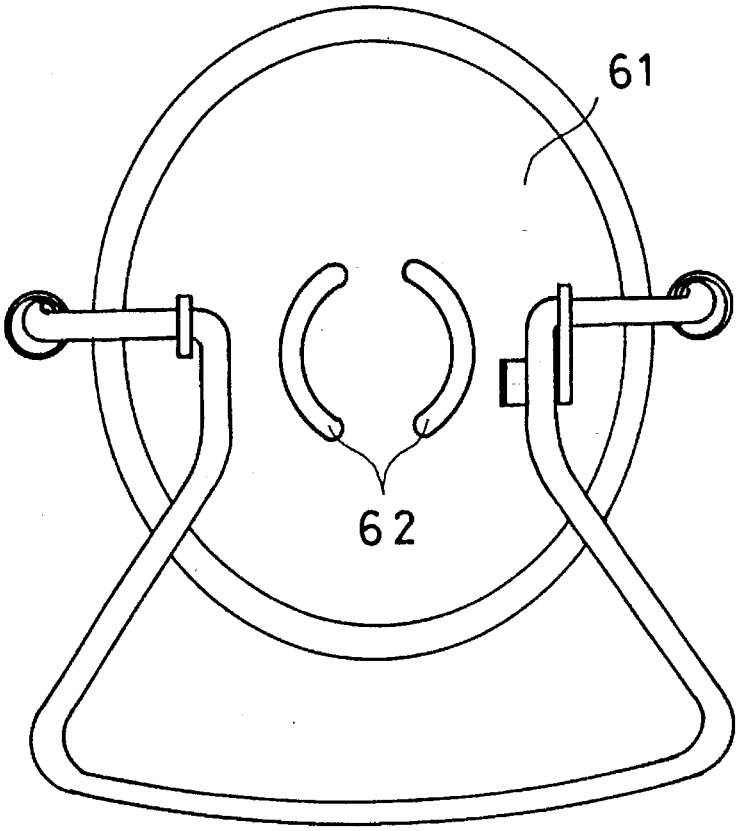
FIG. 1A (PRIOR ART)
FIG. 1A is plan view of a cover including a conventional safety device, and parts associated therewith.
Figure 1B:
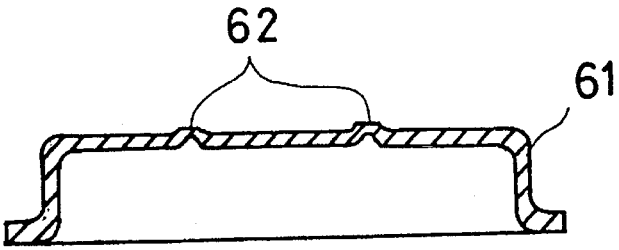
FIG. 1B (PRIOR ART)
FIG. 1B is a cross-sectional view of the conventional safety device.
Figure 2:
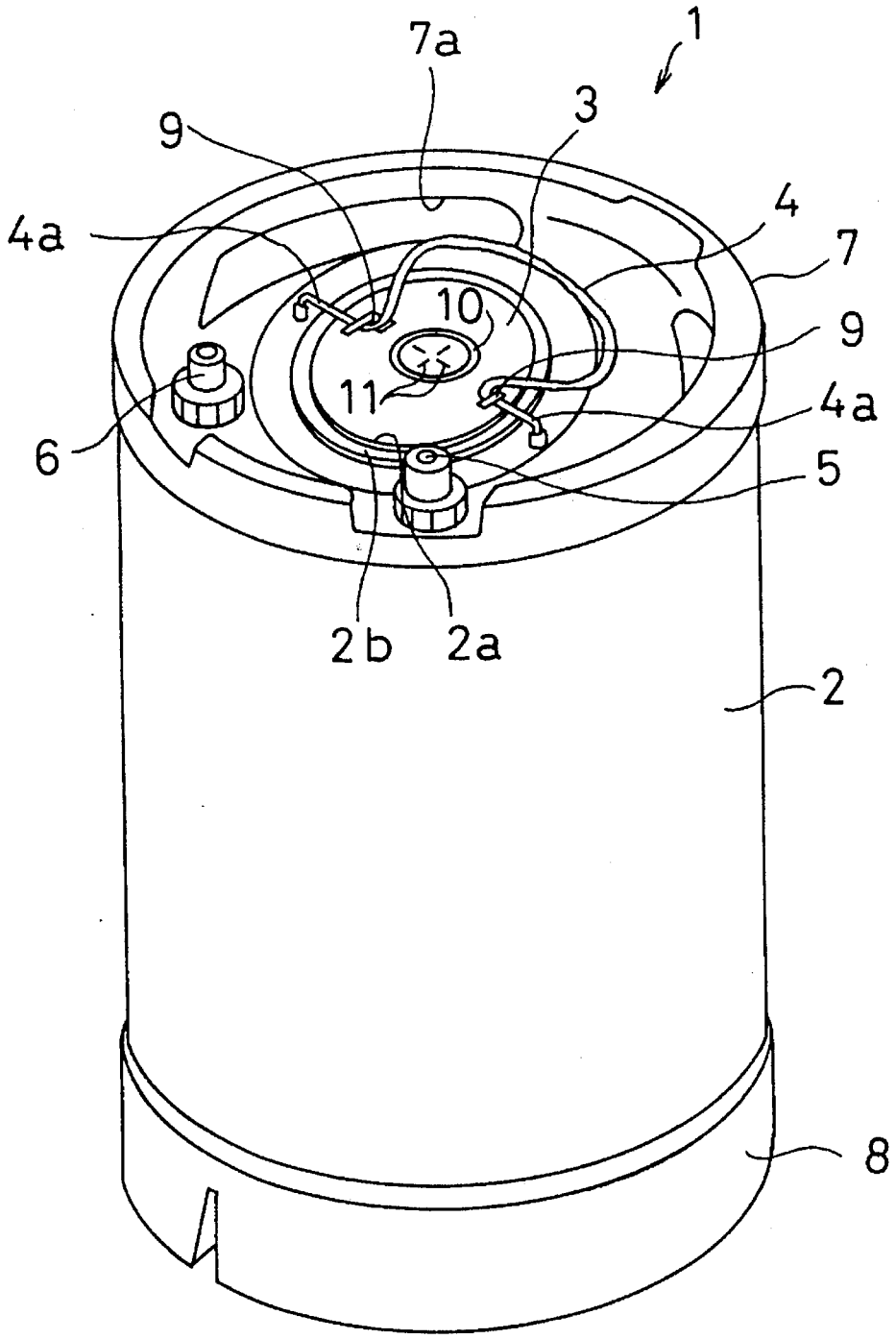
FIG. 2 is a perspective view of a pressure vessel incorporating a safety device according to a first embodiment of the invention.
Figure 3A:
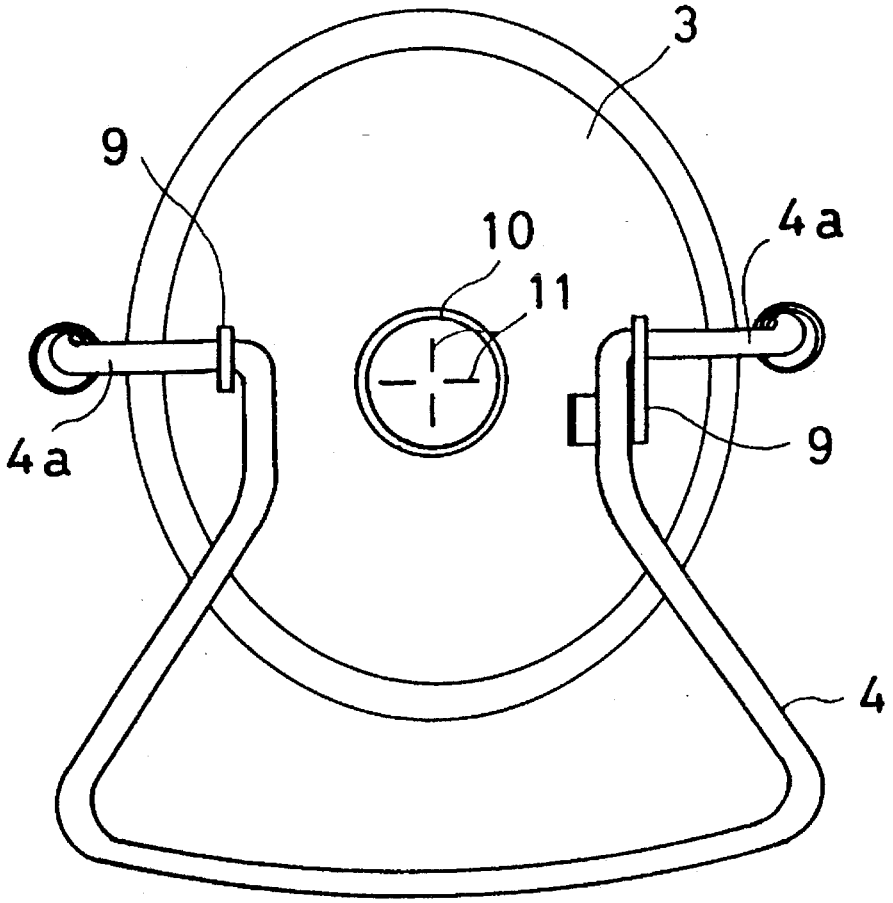
FIG. 3A is a plan view of a cover including the safety device, and parts associated therewith.
Figure 3B:
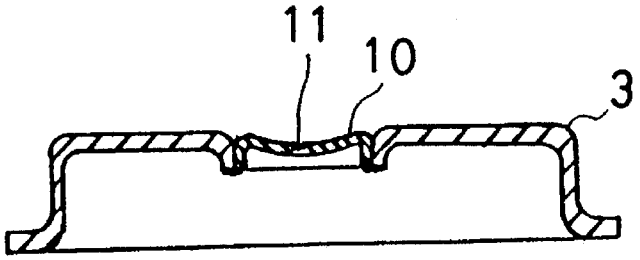
FIG. 3B is a cross-sectional view of the cover including the safety device.
Figure 4A:
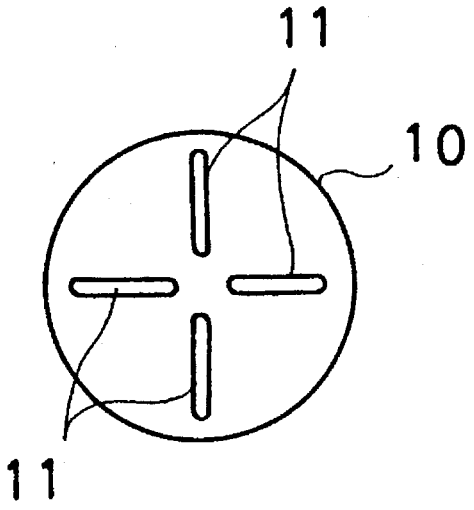
FIG. 4A is a plan view of an easily-breakable member of the safety device of the first embodiment.
Figure 4B:
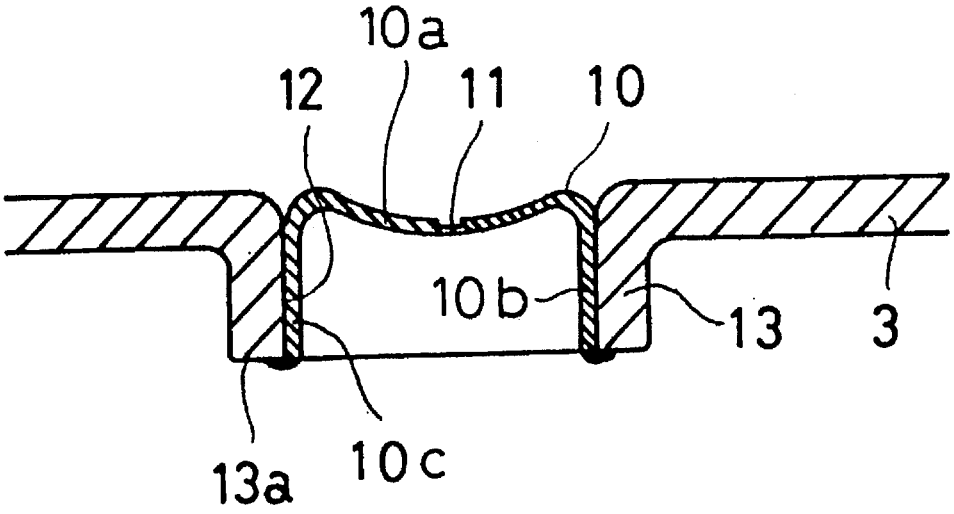
FIG. 4B is a cross-sectional view of the safety device of the first embodiment.

Now, a safety device for a pressure vessel of the present invention will be described in detail with reference to drawings showing embodiments thereof in which the invention is applied to a syrup tank for use in a vending machine. The syrup tank is a stock solution tank for holding a condensed liquid of a vend beverage, such as cola or juice, in stock. The tank is connected to a carbon dioxide bomb or a nitrogen bomb, for supplying the stock solution held therein, e.g. to a cup used in a vending machine, under pressure created by the gas supplied thereto from the bomb. FIG. 2 shows an appearance of a syrup tank 1, while FIG. 3A shows construction of a cover 3 and parts associated therewith, and FIG. 3B shows the cover 3 in cross-section. As shown therein, the syrup tank 1 includes a vessel 2, the cover 3 in an elliptical form for opening and closing a wide mouse 2*a* of the vessel 2, a fixing handle 4 for fixing the cover 3 to the vessel 2, a gas inlet port 5, and a condensed liquid outlet port 6. The syrup tank 1 is supplied for use in a state where the tank is fully charged with condensed liquid, and set in a vending machine such that the gas inlet port 5 is connected to a gas pipe leading to a gas bomb, and the condensed liquid outlet port 6 is connected to a supply pipe for supplying the condensed liquid to a cup. The inside of the syrup tank is pressurized to a level of 4 $kg/cm^2$ by gas supplied via the gas pipe from the gas bomb, thereby permitting the condensed liquid to be supplied under pressure via the supply pipe.

The vessel 2 is formed e.g. of stainless steel, with an upper protector 7 and a lower protector 8, each formed of rubber, having been baked to respective upper and lower ends of the vessel 2. The upper and lower protectors 7, 8 serve as cushioning when syrup tanks are stacked one upon another, and the upper protector 7 is formed with a handle 7*a* for carrying the syrup tank 1 thereby. The vessel 2 has a top thereof formed with the wide mouth 2*a* having an elliptical form in the center thereof, which is defined by a mouth edge 2*b* increased in thickness for reinforcement. The cover 3 in the elliptical form can be inserted into the vessel 2 via the wide mouth 2*a*.

The cover 3 is formed e.g. of a plate of stainless steel having a thickness of 1.5 mm, and is used for closing the wide mouth 2*a* of the vessel 2 from within via an O ring, not shown. To this end, the cover 3 has its periphery bent to form a peripheral wall, which extends toward the inside of the vessel 2 and is flanged at an inner end thereof, as shown in FIG. 3B. The fixing handle 4 has an Ω shape a projected part of which is made level or flat when fixing the cover 3, and is rotatably engaged with a pair of hooks 9, 9 projected from the upper surface of the cover 3. Legs 4*a*, 4*a* of the fixing handle 4 have their bent end portions engaged in portions outside the mouth edge 2*b* of the vessel 2, and their level portions of the legs 4*a*, 4*b* abut on the mouth edge 2*b*, thereby permitting resilient forces of the legs 4*a*, 4*a* to pull up the cover 3 to its fixed position when the projected part is made level. In this connection, when the fixing handle is made upright around the fulcrums of the hooks 9, 9, the level portions of the legs 4*a*, 4*a* are disengaged from the mouth edge 2*b* of the vessel 2, thereby releasing the cover from its fixed position.

On the other hand, as shown in FIG. 3A to FIG. 4B, an easily-breakable member 10 is fixed in a central portion of the cover 3. The easily-breakable member 10 is made e.g. of a plate of stainless steel having a thickness of 0.2 mm, and consists of a top wall portion 10*a* and a peripheral wall portion 10*b*, forming a shape of a cup having a circular transverse cross-section, as a whole. The easily-breakable member 10 is fixed to the cover 3 with its open end directed to the inside of the vessel 2. In the fixed state, the top wall portion 10*a* of the easily-breakable member 10 is slightly curved toward the inside of the vessel. Further, the top wall portion 10*a* is formed with four breakable portions 11, 11, 11, 11, arranged in the form of a cross. The breakable portions 11 are formed by pressing such that they each have a thickness reduced to e.g. approximately 60 μ thereby satisfying a specification of a burst pressure of 10 kg/cm$^2$.

In a manner corresponding to the easily-breakable portion 10 in the form of a cap, the cover 3 is formed with a fixing opening 12 having a shape circular in transverse cross-section and complementary to the periphery of the easily-breakable member 10. The fixing opening 12 is defined by an opening defining part 13 located in a central portion of the cover 3. The opening defining part 13 is formed by bending an internal peripheral edge of the cover 3 defining the fixing opening toward the inside of the vessel 2 to form a wall, by burring or hole expanding. The easily-breakable member 10 is fixed in the fixing opening 12 with its open end directed toward the inside of the vessel 2, and has its inner end 10*c* welded to the opening defining part 13 with the inner end 10*c* aligned with the inner end 13*a* of the opening defining part 13 (more accurately, the inner end 13*a* of the wall of the opening defining part 13).

Figure 5:
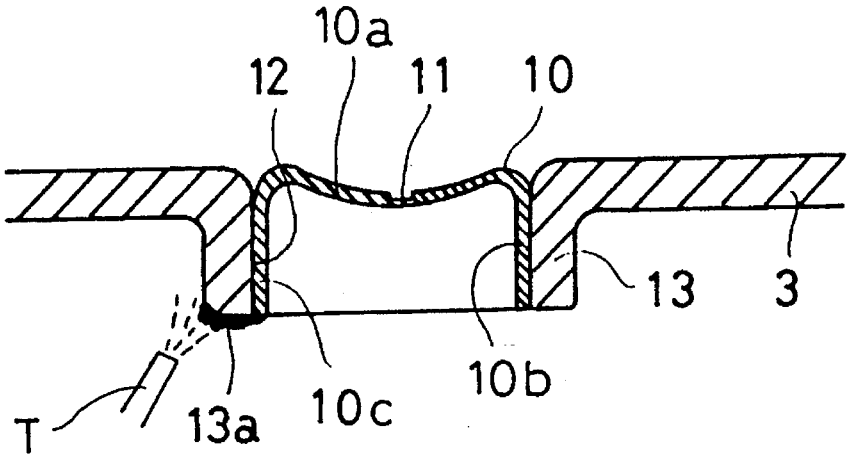
FIG. 5 is a cross-sectional view of the safety device, illustrating a manner of welding of the cover and the easily-breakable member.

The welding of the easily-breakable portion is performed by TIG welding. As shown in FIG. 5, the inner end 13*a* of the opening defining part 13 as a base metal is heated by the use of the torch T for fusion, and the inner end 10*c* of the easily-breakable member 10 is also fused by heat generated in fusing the inner end 13*a* of the opening defining part 13, to thereby cause the both members to be welded to each other for sealing the fixing opening 12. In other words, the opening defining part 13 having a thickness of 1.5 mm and the easily-breakable member having a thickness of 0.2 mm can be fused at respective inner ends thereof by the use of heat applied to the inner end 13*a* of the opening defining part 13 along the circumference of the fixing opening 12, to form an annular air-tight welded part. This makes it possible to properly weld the opening defining part 13 and the easily-breakable member 10 which are largely different in thickness from each other, without causing damage to the easily-breakable member 10 having the smaller thickness.

Figure 6:
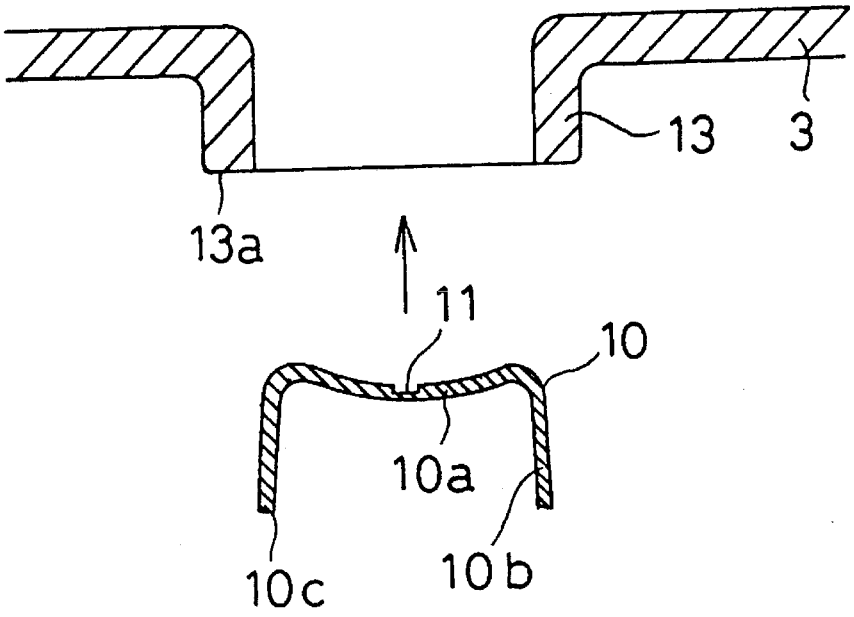
FIG. 6 is an exploded cross-sectional view of a variation of the safety device of the first embodiment.

FIG. 6 shows a variation of the safety device of the first embodiment. In this variation, the peripheral wall portion 10*b* of the easily-breakable member 10 is tapered toward the top wall portion 10*a*. When the easily-breakable member 10 is inserted into the fixing opening 12 from the inner side of the cover 3, the inner end 10*c* of the easily-breakable member and the inner end 13*a* of the opening defining part 13 are tightly fit to each other all over the circumference of the fixing opening 12, thereby ensuring proper welding of the easily-breakable member 10 and the opening defining part 13 to achieve airtightness of the welded part.

Figure 7A:
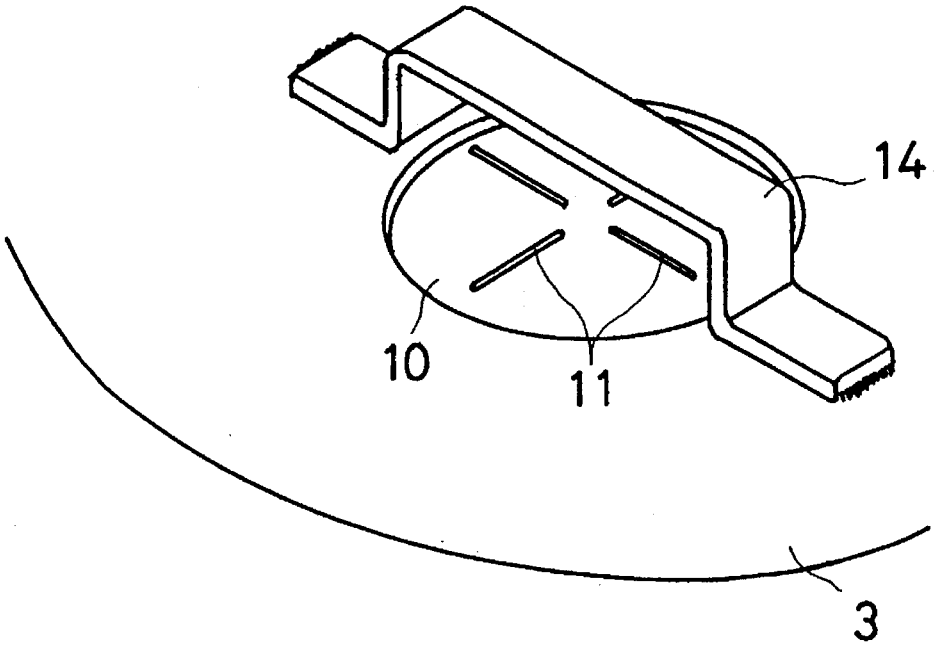
FIG. 7A is a perspective view of another variation of the safety device including a guard member.
Figure 7B:
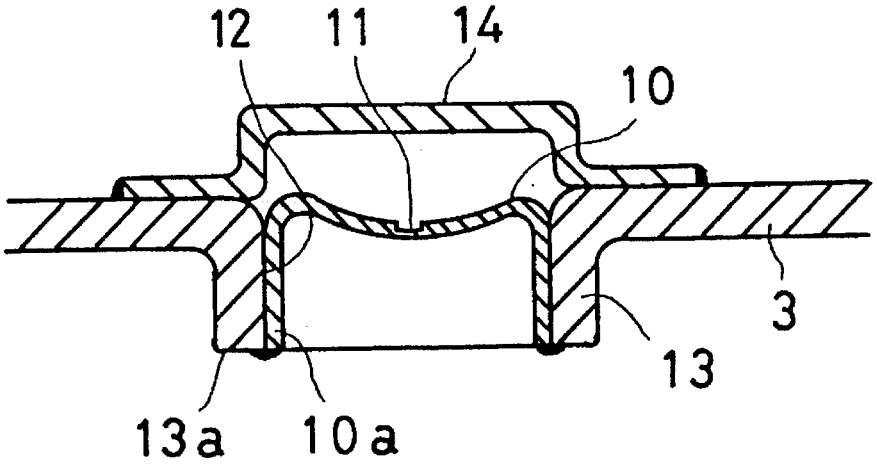
FIG. 7B is a cross-sectional view of the safety device shown in FIG. 7A.
Figure 8:
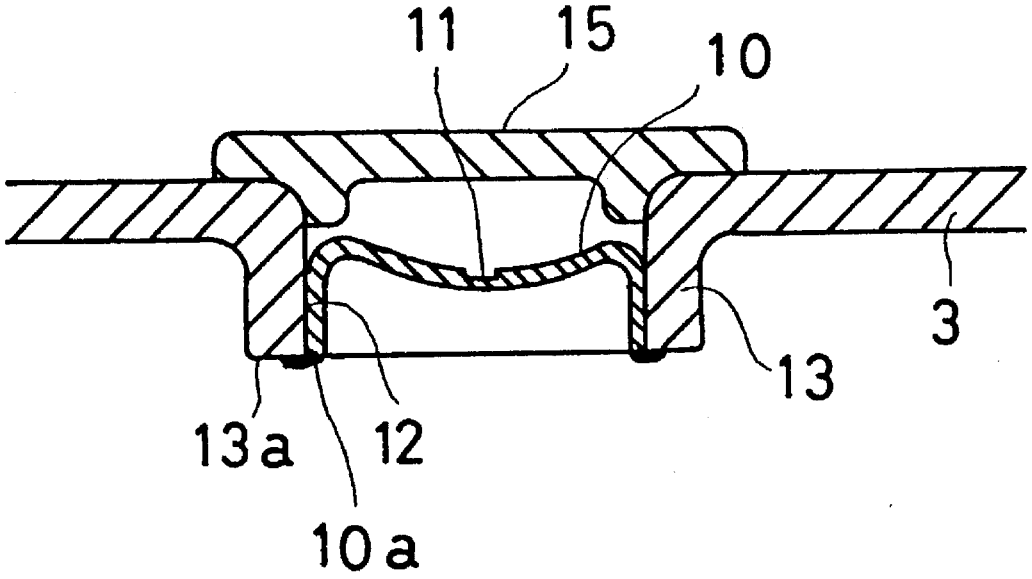
FIG. 8 is a cross-sectional view of another variation of the safety device, including a cap as a protective member.

FIG. 7A to FIG. 8 shows variations of the safety device of the first embodiment, including shield means for protecting the easily-breakable member 10 from being damaged by a force applied from the outside. In a variation shown in FIG. 7A and FIG. 7B, a guard member 14 is mounted on the cover 3 such that it extends over the easily-breakable member 10 in a diametric direction. The guard member 14 is formed by bending a plate of stainless steel having a small width, and has both ends thereof welded to portions of the peripheral edge of the fixing opening 12. Further, in another variation shown in FIG. 8, the shield means is formed as a cap 15 which is fitted into an outer end of the fixing opening 12 to close same. The cap 15 may be formed of rubber or resins, and is press fit into the fixing opening 12.

As described heretofore, according to the present embodiment, the cover 3 having the larger thickness and the easily-breakable member 10 having smaller thickness are formed in separate pieces, and then welded to each other. Therefore, the breakable portions (very thin portions) of the easily-breakable member 10 can be easily formed by pressing. Further, the easily-breakable member 10, which is formed such that it has a shape of a cap, is fit into the fixing opening 12, and then welded to the cover 3, with the inner end 10*a* of the easily-breakable member 10 and the inner end 13*a* of the opening defining part 13 being aligned to each other. This makes it possible to cause the cover 13 having the larger thickness and the easily-breakable member 10 having the smaller thickness to be easily joined to each other without impairing air-tightness of the tank. Further, the easily-breakable member 10 is completely fit into the fixing opening 12, so that the cover 3 is finished such that it has a relatively smooth surface, thereby offering no inconvenience to cleaning works of the syrup tank 1.

Further, the guard member 14 or the cap 15 may be provided to protect the easily-breakable member from external forces. Therefore, it is possible to prevent the easily-breakable member 10 from being carelessly damaged when the syrup tank 1 is washed or conveyed. Further, the cap 15 serves to prevent dust from being attached to the surface of the easily-breakable member 10, which is preferable from the viewpoint of sanitation.

Figure 9A:
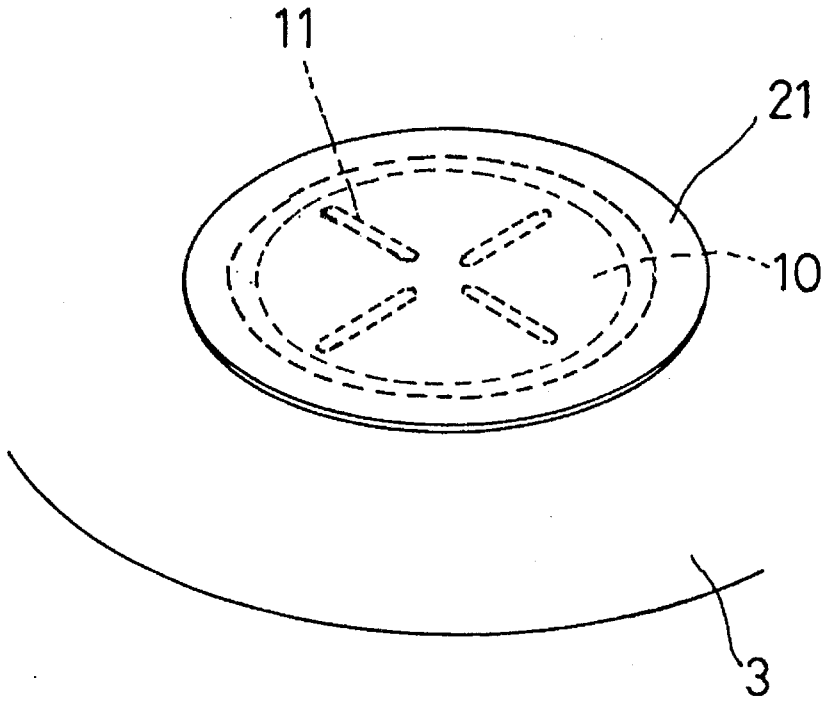
FIG. 9A is a perspective view of a safety device according to a second embodiment in which a cap is joined to an easily-breakable member.
Figure 9B:
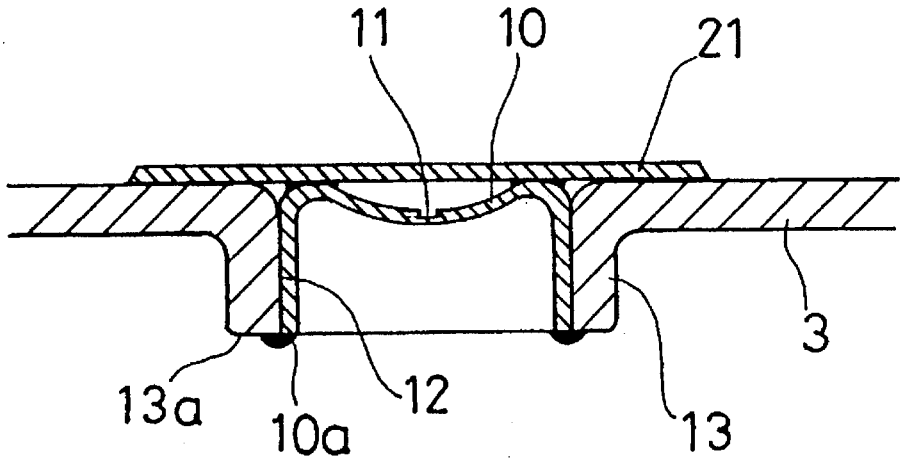
FIG. 9B is a cross-sectional view of the safety device shown in FIG. 9A.

FIG. 9A and FIG. 9B show a second embodiment of the invention in which a cap 21 and the easily-breakable member 10 are joined into one piece. The cap 21 is formed e.g. by a disk of stainless steel, and is joined to the top wall portion 10*a* of the easily-breakable member 10 by spot welding.

According to this construction, when the easily-breakable member 10 is fit into the fixing opening 12 via its outer end, the cap 21 abuts on the peripheral edge of the fixing opening 12 to thereby automatically effect positioning of the easily-breakable member 10. Therefore, it is possible to easily align the inner end 10*a* of the easily-breakable member 10 and the inner end of the opening defining portion 13, prior to welding. Further, the cap 21 is flat on the surface of the cover 3 without largely projecting out therefrom, which ensures protection of the easily-breakable member 10.

Further, although in the embodiments, description has been made of cases where the safety device of the present invention is applied to a syrup tank for vending machines, this not limitative, but it goes without saying that the present invention can be applied to pressure vessels other than those for beverages. Further, it is to be understood that the form of the present invention herein shown and described is to be taken as preferred examples of the same and that various changes in the shape, size, location, arrangement of parts, methods of processing, thickness, etc., may be made to the present safety device, particularly the easily-breakable member thereof, without departing the spirit and scope of the invention.

What is claimed is:

1. A safety device for a pressure vessel comprising:

an easily-breakable member of a first thickness having a top wall formed with a breakable portion of a thickness less than said first thickness, said breakable portion being adapted to break when pressure in the pressure vessel which is applied to said breakable portion is larger than a predetermined pressure, said easily-breakable member having a peripheral wall extending from and surrounding said top wall and having an end; and a fixing member of a thickness greater than said easily-breakable member first thickness for attachment to the pressure vessel and for fixing said easily-breakable member to the pressure vessel, said fixing member having a wall portion which extends toward the inside of said pressure vessel to define an opening having a shape complementary to said peripheral wall of said easily-breakable member to permit communication between the inside and the outside of the said pressure vessel, said fixing member wall portion having an inner end;

said easily-breakable member being fit into said opening of said fixing member such that said end of said easily-breakable member peripheral wall is directed toward the inside of said vessel, and said peripheral wall of said easily-breakable member and said wall portion of said fixing portion being connected to each other for sealing said opening of said fixing portion.

2. A safety device according to claim 1, further comprising a protective member for shielding an outer end of said opening of said fixing portion to protect said easily-breakable member.

3. A safety device according to claim 1, wherein said protective member and said easily-breakable member are welded to each other at the end of said peripheral wall of said easily-breakable member and the end of the wall portion of said fixing member.

4. A safety device as in claim 1 wherein the thickness of said easily-breakable member over its entire extent is thinner than the thickness of said fixing member.

5.A safety device according to claim 1, wherein said breakable portion of said top wall of said easily-breakable member comprises portions in the form of a cross, each having a thickness corresponding to a predetermined burst pressure of the pressure in the vessel.

6. A safety device according to claim 5, wherein said top wall of said easily-breakable member is concave and curved toward the inside of said pressure vessel.

7. A safety device according to claim 5, wherein said end of said peripheral wall of said easily-breakable member and said inner end of said wall portion of said fixing portion are welded together by heating said inner end of said wall portion of said fixing portion along the circumference of said opening for fusion, with said wall portion of said fixing portion being used as a base metal.

8. A safety device according to claim 1, wherein said easily-breakable member is formed of stainless steel.

9.A safety device according to claim 8, wherein said breakable portion of said top wall of said easily-breakable member comprises portions in the form of a cross, each having a thickness corresponding to a predetermined burst pressure of the pressure in the vessel.

10. A safety device according to claim 9, said protective member and said easily-breakable member are joined to each other at the end of said peripheral wall of said easily-breakable member and the end of the wall portion of said fixing member.

11. A safety device according to claim 8, wherein said top wall of said easily-breakable member is formed concave and curved toward the inside of said pressure vessel.

12. A safety device according to claim 8, wherein said end of said peripheral wall of said easily-breakable member and said inner end of said wall portion of said fixing portion are welded together by heating said inner end of said wall portion of said fixing portion along the circumference of said opening for fusion, with said wall portion of said fixing portion being used as a base metal.

13. A safety device according to claim 1, where said opening defined by said wall portion of said fixing member has a circular transverse cross-section, and said peripheral wall of said easily-breakable member is tapered toward said top wall of said easily-breakable member.

14. A safety device according to claim 13, wherein said breakable portion of said top wall of said easily-breakable member comprises portions in the form of a cross, each having a thickness corresponding to a predetermined burst pressure of the pressure in the vessel.

15. A safety device according to claim 13, wherein said top wall of said easily-breakable member is formed concave and curved toward the inside of said pressure vessel.

16. A safety device according to claim 13, wherein said end of said peripheral wall of said easily-breakable member and said inner end of said wall portion of said fixing portion are welded together by heating said inner end of said wall portion of said fixing portion along the circumference of said opening for fusion, with said wall portion of said fixing portion being used as a base metal.

17. A safety device as in claim 13 wherein the thickness of said easily-breakable member over its entire extent is thinner than the thickness of the said fixing member.

18. A safety device according to claim 13, further comprising a protective member for shielding an outer end of said opening of said fixing portion to protect said easily-breakable member.

19. A safety device according to claim 13, wherein said easily-breakable member is formed of stainless steel.

20. A safety device according to claim 19, wherein said breakable portion of said top wall of said easily-breakable member comprises portions in the form of a cross, each having a thickness corresponding to a predetermined burst pressure of the pressure in the vessel.

21. A safety device according to claim 19, wherein said top wall of said easily-breakable member is formed concave and curved toward the inside of said pressure vessel.

22. A safety device according to claim 19, wherein said end of said peripheral wall of said easily-breakable member and said inner end of said wall portion of said fixing portion are welded together by heating said inner end of said wall portion of said fixing portion along the circumference of said opening for fusion, with said wall portion of said fixing portion being used as a base metal.

* * * * *